US008503708B2

(12) United States Patent
Galster et al.

(10) Patent No.: US 8,503,708 B2
(45) Date of Patent: Aug. 6, 2013

(54) HEARING ASSISTANCE DEVICE WITH PROGRAMMABLE DIRECT AUDIO INPUT PORT

(75) Inventors: Elizabeth Galster, Minneapolis, MN (US); Holly Schissel, Excelsior, MN (US); Mohammad Ali Enteshari, Edina, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 238 days.

(21) Appl. No.: 12/982,526

(22) Filed: Dec. 30, 2010

(65) Prior Publication Data

US 2011/0249837 A1 Oct. 13, 2011

Related U.S. Application Data

(60) Provisional application No. 61/321,944, filed on Apr. 8, 2010.

(51) Int. Cl.
*H04R 25/00* (2006.01)

(52) U.S. Cl.
USPC ..... 381/330; 381/312

(58) Field of Classification Search
USPC ..... 381/312, 313, 326, 327, 328, 330
See application file for complete search history.

(56) References Cited

U.S. PATENT DOCUMENTS

| | | | | |
|---|---|---|---|---|
| 3,493,695 | A | 2/1970 | Stork | |
| 3,742,359 | A | 6/1973 | Behymer | |
| 4,961,230 | A | 10/1990 | Rising | |
| 5,157,405 | A | 10/1992 | Wycoff et al. | |
| 5,204,917 | A | 4/1993 | Arndt et al. | |
| 5,389,009 | A | 2/1995 | Van Schenck, III | |
| 5,426,689 | A | 6/1995 | Griffith et al. | |
| 5,502,769 | A | 3/1996 | Gilbertson | |
| 5,515,443 | A | 5/1996 | Meyer | |
| 5,717,771 | A | 2/1998 | Sauer et al. | |
| 5,721,783 | A | 2/1998 | Anderson | |
| 5,761,319 | A | 6/1998 | Dar et al. | |
| 5,793,875 | A | 8/1998 | Lehr et al. | |
| 6,078,825 | A | 6/2000 | Hahn et al. | |
| 6,144,748 | A * | 11/2000 | Kerns | 381/312 |

(Continued)

FOREIGN PATENT DOCUMENTS

| | | |
|---|---|---|
| CH | 673551 | 3/1990 |
| EP | 0789474 A2 | 8/1997 |

(Continued)

OTHER PUBLICATIONS

"U.S. Appl. No. 11/207,555, Final Office Action mailed Jan. 22, 2009", 15 pgs.

(Continued)

*Primary Examiner* — Brian Ensey
(74) *Attorney, Agent, or Firm* — Schwegman, Lundberg & Woessner, P.A.

(57) ABSTRACT

Apparatus and methods to detect signals connected to a direct audio input port of a hearing assistance device are provided. According to one embodiment, a hearing assistance device includes a processor and a direct audio input (DAI) port including a signal line connected to the processor. The DAI port is configured to connect to an external device, and the processor is programmed to detect audio signals of interest on the signal line and to process the audio signals of interest when detected as programmed.

32 Claims, 6 Drawing Sheets

U.S. PATENT DOCUMENTS

| | | | |
|---|---|---|---|
| 6,157,728 | A | 12/2000 | Tong et al. |
| 6,230,029 | B1 | 5/2001 | Hahn et al. |
| 6,319,020 | B1 | 11/2001 | Brimhall et al. |
| 6,381,308 | B1 | 4/2002 | Cargo et al. |
| 6,760,457 | B1 | 7/2004 | Bren et al. |
| 6,888,948 | B2 | 5/2005 | Hagen et al. |
| 7,054,957 | B2 | 5/2006 | Armitage |
| 7,099,486 | B2 | 8/2006 | Julstrom et al. |
| 7,139,404 | B2 | 11/2006 | Feeley et al. |
| 7,142,814 | B2 | 11/2006 | Nassimi |
| 7,149,552 | B2 | 12/2006 | Lair |
| 7,181,032 | B2 | 2/2007 | Jakob et al. |
| 7,257,372 | B2 | 8/2007 | Kaltenbach et al. |
| 7,450,078 | B2 | 11/2008 | Knudsen et al. |
| 7,787,647 | B2 | 8/2010 | Hagen et al. |
| 7,813,762 | B2 | 10/2010 | Sanguino et al. |
| 7,929,723 | B2 | 4/2011 | Hagen et al. |
| 2001/0007335 | A1 | 7/2001 | Tuttle et al. |
| 2002/0090099 | A1 | 7/2002 | Hwang |
| 2002/0131614 | A1 | 9/2002 | Jakob et al. |
| 2002/0132585 | A1 | 9/2002 | Palermo et al. |
| 2003/0045283 | A1 | 3/2003 | Hagedoorn |
| 2003/0078071 | A1 | 4/2003 | Uchiyama |
| 2003/0133582 | A1 | 7/2003 | Niederdrank |
| 2003/0231783 | A1 | 12/2003 | Kah |
| 2004/0010181 | A1 | 1/2004 | Feeley et al. |
| 2004/0077387 | A1 | 4/2004 | Sayag et al. |
| 2004/0136555 | A1 | 7/2004 | Enzmann |
| 2004/0141628 | A1 | 7/2004 | Villaverde et al. |
| 2004/0204921 | A1 | 10/2004 | Bye |
| 2004/0208333 | A1 | 10/2004 | Cheung et al. |
| 2005/0008178 | A1 | 1/2005 | Joergensen et al. |
| 2005/0078844 | A1 | 4/2005 | Von |
| 2005/0099341 | A1 | 5/2005 | Zhang et al. |
| 2005/0249371 | A1 | 11/2005 | Vogt |
| 2006/0039577 | A1 | 2/2006 | Sanguino et al. |
| 2006/0044140 | A1 | 3/2006 | Berg |
| 2006/0057973 | A1 | 3/2006 | Wikel et al. |
| 2006/0068842 | A1 | 3/2006 | Sanguino et al. |
| 2006/0193375 | A1 | 8/2006 | Lee |
| 2006/0245611 | A1 | 11/2006 | Jorgensen et al. |
| 2007/0004464 | A1 | 1/2007 | Lair et al. |
| 2007/0080889 | A1 | 4/2007 | Zhang |
| 2007/0230727 | A1 | 10/2007 | Sanguino et al. |
| 2008/0137888 | A1 | 6/2008 | Newton et al. |
| 2008/0232623 | A1 | 9/2008 | Solum et al. |

FOREIGN PATENT DOCUMENTS

| | | | |
|---|---|---|---|
| JP | 10084209 | | 3/1998 |
| WO | WO-9931936 | A1 | 6/1999 |
| WO | WO-03047310 | A1 | 6/2003 |
| WO | WO-2006023857 | A1 | 3/2006 |
| WO | WO-2006023920 | A1 | 3/2006 |

OTHER PUBLICATIONS

"U.S. Appl. No. 11/207,555, Final Office Action mailed Feb. 4, 2010", 13 pgs.
"U.S. Appl. No. 11/207,555, Non-Final Office Action mailed Jun. 3, 2008", 12 pgs.
"U.S. Appl. No. 11/207,555, Non-Final Office Action mailed Jul. 16, 2009", 12 pgs.
"U.S. Appl. No. 11/207,555, Response filed Jun. 22, 2009 to Final Office Action mailed Jan. 22, 2009", 9 pgs.
"U.S. Appl. No. 11/207,555, Response filed Nov. 3, 2008 to Non Final Office Action mailed Jun. 3, 2008", 8 pgs.
"U.S. Appl. No. 11/207,555, Response filed Nov. 16, 2009 to Non-Final Office Action mailed Jul. 15, 2009", 8 pgs.
"U.S. Appl. No. 11/207,591, Final Office Action mailed Jan. 6, 2009", 13 pgs.
"U.S. Appl. No. 11/207,591, Final Office Action mailed Jan. 15, 2010", 13 pgs.
"U.S. Appl. No. 11/207,591, Non-Final Office Action mailed Jul. 14, 2009", 13 pgs.
"U.S. Appl. No. 11/207,591, Non-Final Office Action mailed Jul. 28, 2008", 11 pgs.
"U.S. Appl. No. 11/207,591, Non-Final Office Action mailed Nov. 16, 2007", 9 pgs.
"U.S. Appl. No. 11/207,591, Response filed May 6, 2008 to Non Final Office Action mailed Nov. 16, 2007", 8 pgs.
"U.S. Appl. No. 11/207,591, Response filed May 6, 2009 to Final Office Action mailed Jan. 6, 2009", 8 pgs.
"U.S. Appl. No. 11/207,591, Response filed Oct. 14, 2009 to Non Final Office Action mailed Jul. 14, 2009", 10 pgs.
"U.S. Appl. No. 11/207,591, Response filed Oct. 28, 2008 to Non Final Office Action mailed Jul. 28, 2008", 7 pgs.
"U.S. Appl. No. 11/207,591, Notice of Allowance mailed Jul. 1, 2010", 9 Pgs.
"U.S. Appl. No. 11/207,591, Response filed Jun. 15, 2010 to Final Office Action mailed Jan. 15, 2010", 9 pgs.
"U.S. Appl. No. 11/692,763, Non-Final Office Action mailed Jan. 21, 2010", 11 pgs.
"U.S. Appl. No. 11/692,763, Response filed Jun. 21, 2010 to Non Final Office Action mailed Jan. 21, 2010", 9 pgs.
"European Application Serial No. 05790836.0, Office Action Mailed Jan. 4, 2009", 3 pgs.
"European Application Serial No. 08250941.5, Extended European Search Report mailed Aug. 18, 2010", 7 pgs.
"Hearing Aids—Part 12: Dimensions of electrical connector systems", IEC 118-12, (1996), 24 pgs.
"Hearing Aids—Part 6: Characteristics of electrical input circuits for hearing aids", IEC 60118-6, (1999), 12 pgs.
"International Application Serial No. PCT/US2005/029793, International Preliminary Report on Patentability mailed Mar. 1, 2007", 5 pgs.
"International Application Serial No. PCT/US2005/029793, International Search Report mailed Jan. 5, 2006", 7 pgs.
"International Application Serial No. PCT/US2005/029793, Written Opinion mailed Jan. 5, 2006", 4 pgs.
"International Application Serial No. PCT/US2005/029971, International Preliminary Report on Patentability mailed Mar. 1, 2007", 6 pgs.
"International Application Serial No. PCT/US2005/029971, International Search Report mailed Jan. 5, 2006", 7 pgs.
"International Application Serial No. PCT/US2005/029971, Written Opinion mailed Jan. 5, 2006", 4 pgs.
Haartsen, J., "Bluetooth—The Universal Radio Interface for Ad Hoc, Wireless Connectivity", Ericsson Review, No. 3, (1998), 110-117.
Preves, D. A., "A Look at the Telecoil—Its Development and Potential", SHHH Journal, (Sep./Oct. 1994), 7-10.
Valente, Michael, et al., "Audiology: Treatment", Thieme Medical Publishers, (Mar. 1, 2000), 594-599.
U.S. Appl. No. 11/689,362 , Response filed Dec. 17, 2012 to Non Final Office Action mailed Jul. 17, 2012, 9 pgs.
U.S. Appl. No. 11/689,362, Non Final Office Action mailed Jul. 17, 2012, 13 pgs.
U.S. Appl. No. 11/689,362, Response filed Apr. 20, 2012 to Non Final Office Action maield Dec. 20, 2011, 11 pgs.
U.S. Appl. No. 11/689,362,Non Final Office Action mailed Dec. 20, 2011, 14 pgs.

* cited by examiner

HEARING ASSISTANCE DEVICE WITH PROGRAMMABLE DIRECT AUDIO INPUT PORT

RELATED APPLICATION

The present application claims the benefit under 35 U.S.C. 119(e) of U.S. Provisional Patent Application Ser. No. 61/321,944, filed Apr. 8, 2010, which is incorporated herein by reference in its entirety.

FIELD OF THE INVENTION

The present subject matter relates generally to hearing assistance devices and in particular to a hearing assistance device with a programmable direct audio input port.

BACKGROUND

Modern hearing assistance devices, such as hearing aids typically include a digital signal processor in communication with a microphone and receiver. Such designs are adapted to perform a great deal of processing on sounds received by the microphone. These designs can be highly programmable and may use inputs from remote devices, such as wired and wireless devices.

One type of input found in hearing assistance devices is a direct audio input or DAI. A connector designed in the hearing assistance device, such as a hearing aid, provides direct audio signals to the hearing aid to play for the wearer.

Various input devices can be used with the DAI port of a hearing aid. One issue with conventional designs is that signals from the DAI are typically used instead of the traditional signal processing channel of the device when a DAI compatible device is connected. This can be a problem depending on the particular DAI compatible device connected to the hearing aid.

Accordingly, there is a need in the art for apparatus and methods to provide improved control of direct audio input signals processed by a hearing assistance device.

SUMMARY

Disclosed herein, among other things, are apparatus and methods to detect signals connected to a direct audio input port of a hearing assistance device and a hearing assistance device with a programmable direct audio input port. The present subject matter provides for programmable processing of signals received from a signal source connected to the direct audio input (DAI) port of the hearing assistance device, such as a hearing aid.

According to one embodiment, a hearing assistance device includes a processor and a direct audio input (DAI) port including a signal line connected to the processor. The DAI port is configured to connect to an external device, and the processor is programmed to detect audio signals of interest on the signal line and to process the audio signals of interest when detected as programmed.

According to one embodiment, a method includes detecting a signal of interest from a signal received at a direct audio input (DAI) port of a hearing assistance device. The signal of interest is processed based on programming of a processor connected to the DAI port. Other embodiments are possible without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
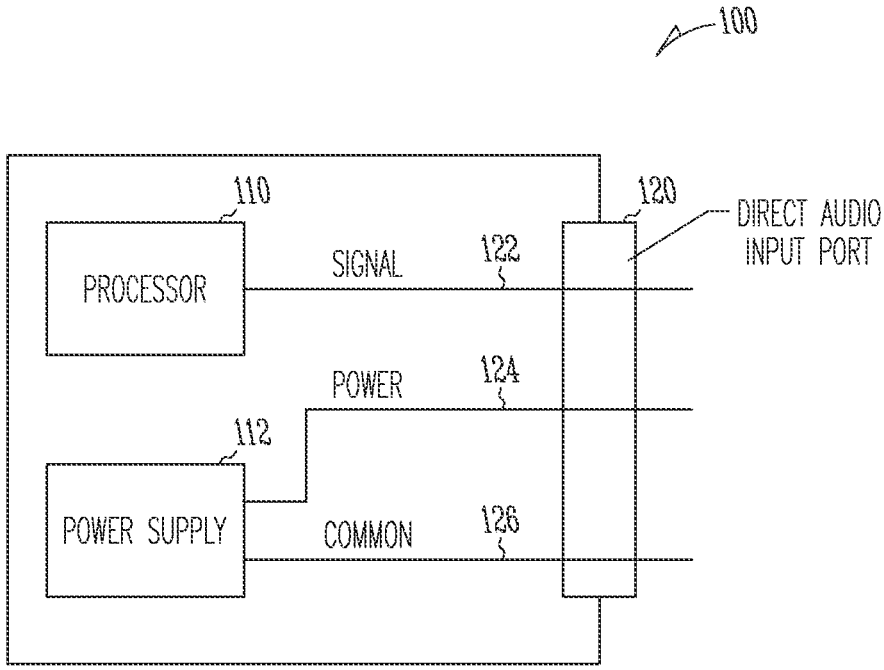
FIG. 1 shows a block diagram of a hearing assistance device according to one embodiment of the present subject matter.

FIG. 1 shows a block diagram of a hearing assistance device 100 according to one embodiment of the present subject matter. In this exemplary embodiment the hearing assistance device 100 includes a processor 110 and at least one power supply 112. The hearing assistance device 100 further includes a direct audio input port 120 (or DAI port 120) that is configured to provide a signal line 122 to processor 110 and provides connections to the power 124 and common 126 connections from power supply 112. The processor 110 is configured to programmably sense and process signals received from the signal line 122 of DAI port 120. In one embodiment, the processor 110 is a digital signal processor (DSP). In one embodiment, the processor 110 is a microprocessor. In one embodiment, the processor 110 is a microcontroller. In one embodiment, the processor 110 is a combination of components. It is understood that in various embodiments, the processor 110 can be realized in a configuration of hardware or firmware or combinations of both.

In various embodiments, signals from signal line 122 are detected for information of interest and used by the processor 110 when such information of interest is detected. In various embodiments, the processor 110 is programmed to provide different processing functions depending on the signals sensed from the signal line 122.

One example, which is intended to demonstrate the present subject matter, but is not intended in a limiting or exclusive sense, is that the signals from signal line 122 are detected to determine the presence of speech. Processor 110 may take different actions depending on whether the speech is detected or not. For example, if processor 110 senses signals, but not signals of interest (for this example, speech), then processor 110 may be programmed to squelch or ignore the sounds received from the DAI port 120 until speech is detected. Processor 110 can be programmed in a plurality of modes to change operation upon detection of the signal of interest (for example, audio or speech).

Figure 2:
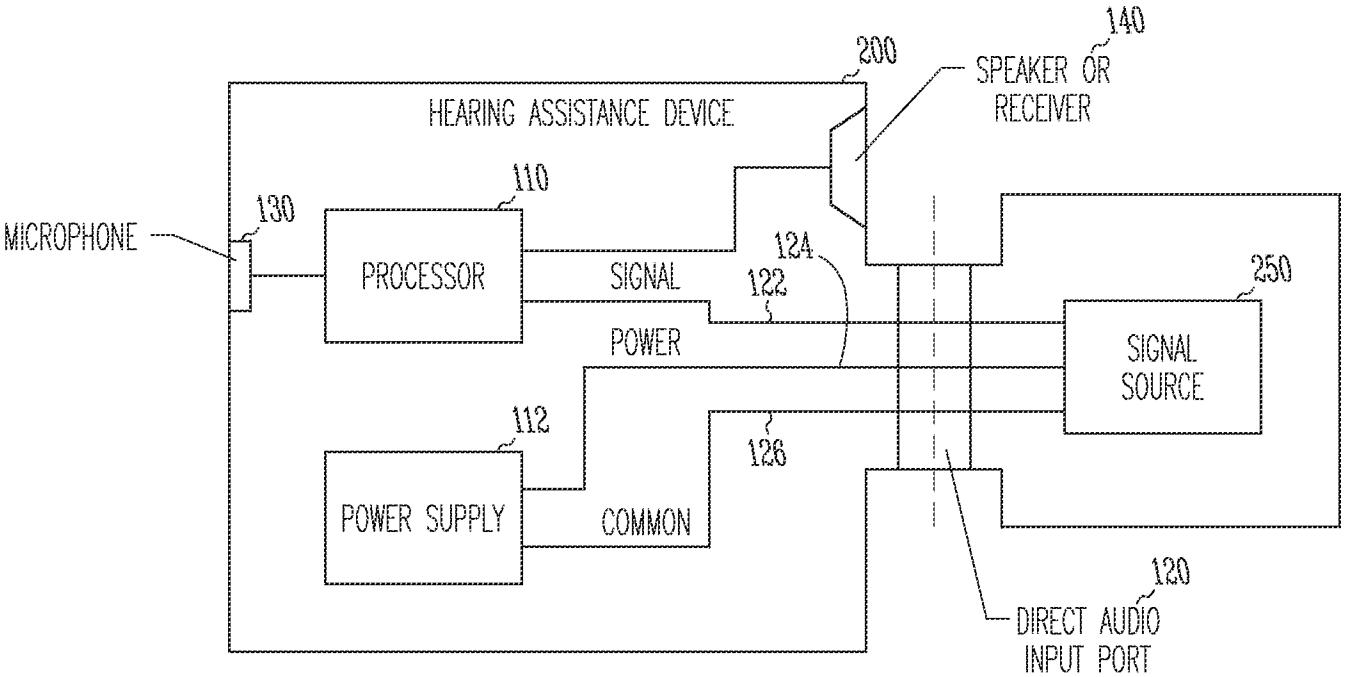
FIG. 2 shows a block diagram of the hearing assistance device of FIG. 1 in a hearing aid application according to one embodiment of the present subject matter.

The hearing assistance device 200 of FIG. 2 is one embodiment of a hearing aid application where a microphone 130 is configured to provide signals to the processor 110 which are processed and played to the wearer with speaker 140 (also known as a "receiver" in the hearing aid art). In such embodiments, the signals on signal line 122 may be from a number of different signal sources 250, such as audio information from a FM radio receiver, signals from a BLUETOOTH or other wireless receiver, signals from a magnetic induction source, signals from a wired audio connection, signals from a cellular phone, or signals from any other signal source. In such applications, the sounds received by DAI port 120 may be squelched or ignored unless information containing speech is detected by processor 110. Processor 110 can be programmed to play the detected speech information exclusively to the wearer using receiver 140. Processor 110 can also be programmed to mix the speech signals coming from signal line 122 with sounds detected by microphone 130. In various embodiments, the sounds from microphone 130 are attenuated by about 6 dB and the signals from the DAI signal source are played to the wearer. In various embodiments, the amount of attenuation is programmable. When the signals from the signal source are no longer present or are not indicative of speech like sound, they can be squelched or ignored and the microphone 130 signals can be played to the wearer without attenuation or other modifications. Different mixing approaches, different attenuations, different combinations of inputs and different types of signal detection may be employed without departing from the present subject matter.

In various embodiments, signal source 250 is powered by the hearing assistance device 200. In various embodiments, signal source 250 has its own power supply.

Figure 3:
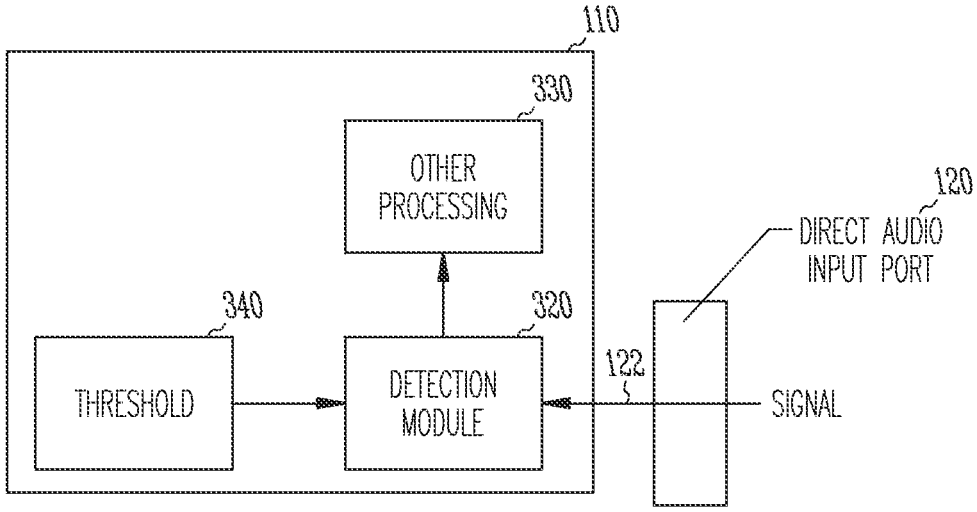
FIG. 3 shows a block diagram of a signal detection approach according to one embodiment of the present subject matter.

FIG. 3 shows a block diagram of a signal detection approach according to one embodiment of the present subject matter. Processor 110 can include different processing blocks, such as detection module 320 which is configured to sense signals from signal line 122 and provide a signal to the other processing blocks 330 based on the incoming signals. In various embodiments, a programmable threshold 340 can be used, to set a minimum threshold of sound energy that must be detected before the signals will be transferred to the other processing blocks 330. In various embodiments, a root-mean-square algorithm is programmed into the detection module 320 to detect the incoming signal line 122 and determine if it has sufficient signal energy compared to the threshold 340. If so, the signal is processed further. If not, it is gated off as it is likely noise or a poor reception. Other signal processing algorithms may be employed and the ones discussed herein are provided as examples and not in an exhaustive or exclusive sense. It is understood that the detection module 320, threshold 340, and other processing 330 can be implemented in a single digital signal processor in various embodiments. In various embodiments, signal line 122 is fed into an A/D converter. In various embodiments, signal line 122 is an interrupt of a processor, digital signal processor, or microcontroller. In various embodiments, detection module 320 includes another output to the other signal blocks 330 which provides a gating function. Therefore the present subject matter is highly configurable and programmable and provides a more intelligent use of the DAI signal inputs so that the processing channel of the hearing assistance device is not dominated by a single DAI input when the incoming signals are not of interest.

The direct audio input connections used in this application include but are not limited to those connectors specified in CEI/IEC 118-12 and CI/IEC 60118-6 which are hereby incorporated by reference in their entirety. This application incorporates by reference the entire specifications of the following commonly owned U.S. applications: U.S. application Ser. No. 11/207,591 filed Aug. 18, 2005, "WIRELESS COMMUNICATIONS ADAPTER FOR A HEARING ASSISTANCE DEVICE"; U.S. Provisional Patent Application Ser. No. 60/602,496 filed Aug. 18, 2004, "WIRELESS COMMUNICATIONS ADAPTER FOR A HEARING ASSISTANCE DEVICE"; and U.S. application Ser. No. 11/689,362 filed Mar. 21, 2007, "SYSTEM FOR PROVIDING POWER TO A HEARING ASSISTANCE DEVICE." Various types of DAI configurations and specifications in the foregoing applications may be used in conjunction with one or more teachings provided herein.

The present subject matter overcomes the problem where a single signal source dominates the processing channel of the hearing assistance device. Thus, the present subject matter provides a more flexible and programmable approach to selectively using the information received from a direct audio input port of a hearing assistance device. In various embodiments the present subject matter allows for interrupt driven processing of accessories or components attached to the DAI port of a hearing assistance device, such as a hearing aid.

In various embodiments, the DAI port allows for the transmission of an electrical audio signal directly to the hearing aid via equipment external to the hearing aid. The goal of using DAI is to improve signal-to-noise ratio for a signal of interest.

In various embodiments, different states of DAI functionality are supported by the hardware and firmware of the hearing aid. For example, one approach is to deem the signals from the DAI port to be off, active, or dormant. In the off state, the DAI port is effectively receiving no information of interest and processing can be omitted to save overhead. In the active state, the DAI processing is important to determine the operation of the hearing aid based on signals from the DAI port. In dormant state, the DAI device is connected, but no signals have been detected for a timeout delay.

So in the example of an FM device (such as an FM receiver or FM receiver/transmitter) connected to the hearing aid, when the FM device is off or when it is out of range, the state of the DAI port would be in the "off" state. When the FM device is on and provides an audio signal, then the state of the DAI port is "active." And when the FM device is on and connected, but no audio is present for a predetermined time, the DAI port is "dormant."

Figure 4:
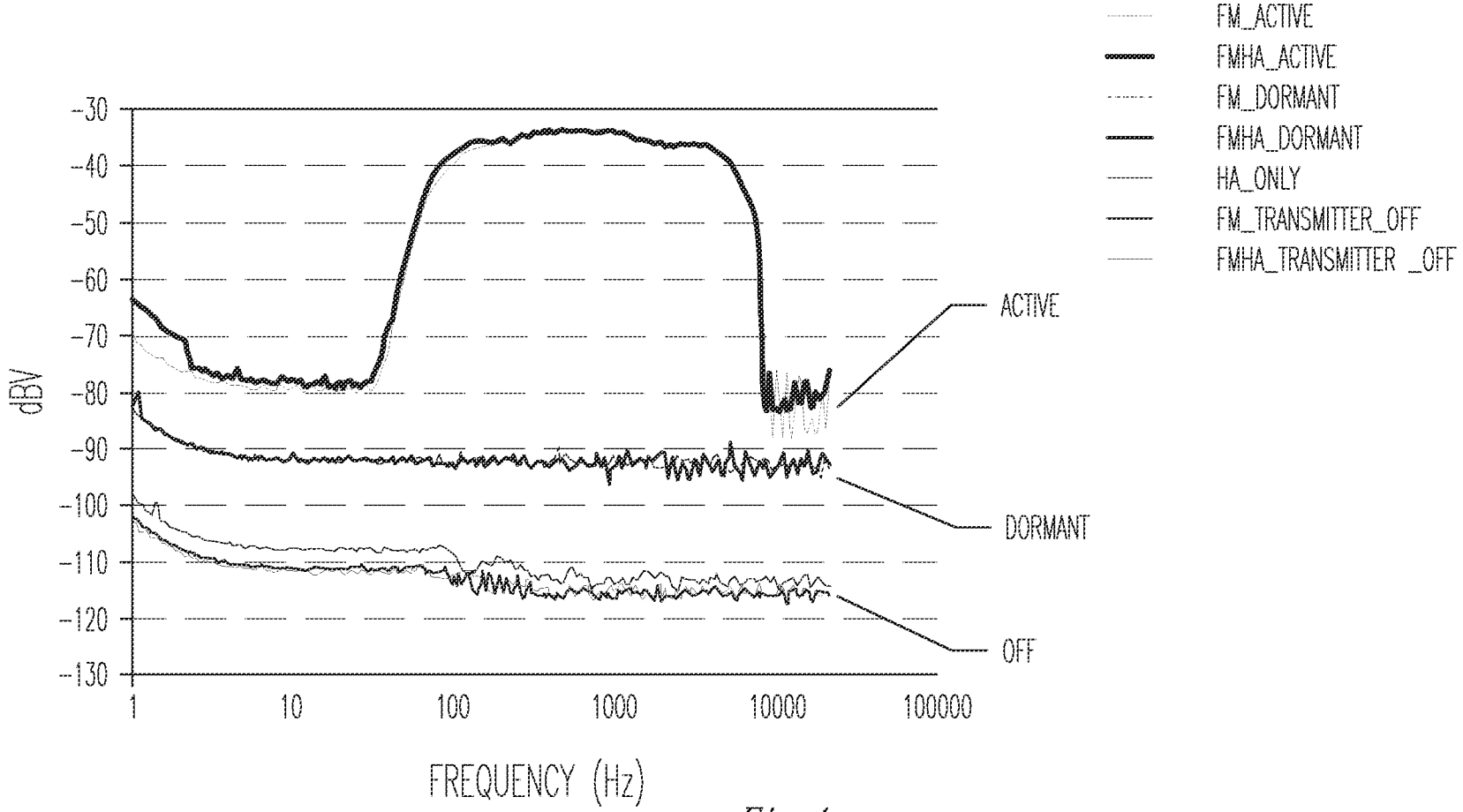
FIG. 4 demonstrates different spectral aspects of the direct audio input signal in three different modes according to one embodiment of the present subject matter.

One way to assess the state of the DAI port is to analyze the signals coming from the port from a frequency and amplitude perspective. If the signals are essentially flat in bands of interest and at a very low amplitude, the DAI port state is "off." If the signals are flat in the bands of interest and at a higher amplitude than the off state, then the DAI port state is "dormant." If substantial frequency variation exists in the bands of interest and the amplitude is higher than the off and dormant states, then the DAI port is in the "active" state. This is demonstrated in FIG. 4.

Figure 5:
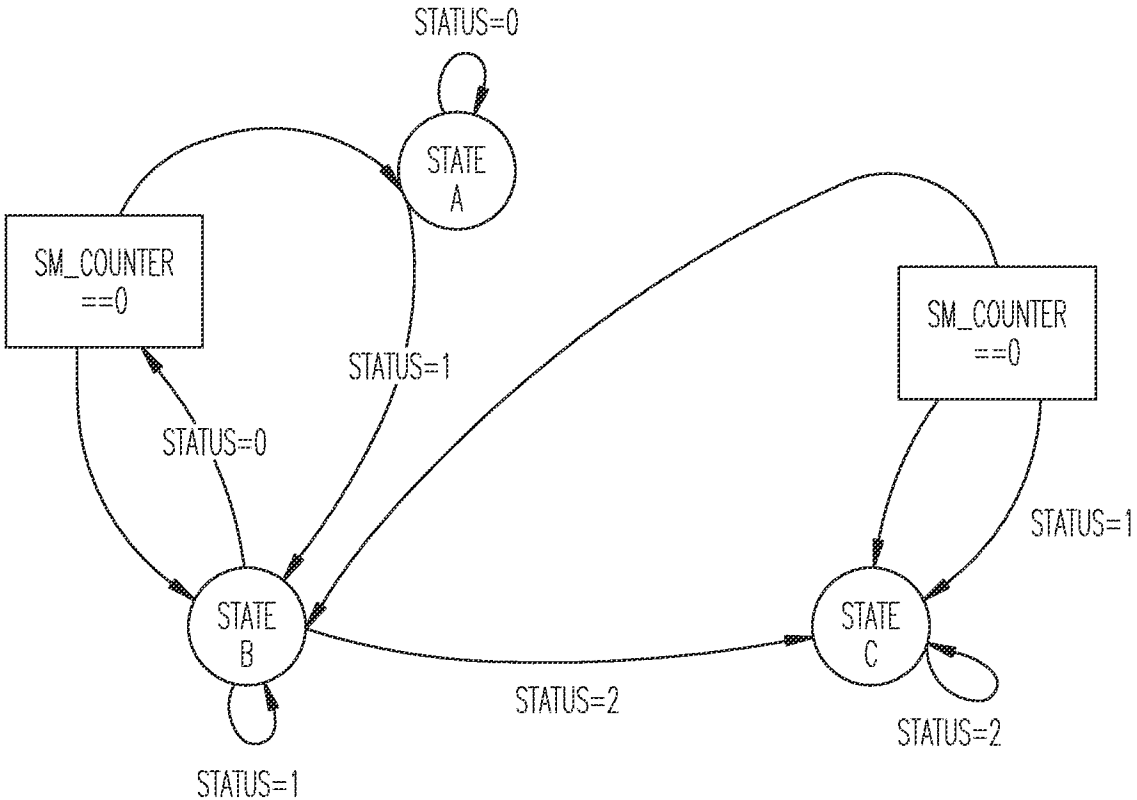
FIG. 5 is a state diagram showing a direct audio input state machine according to one embodiment of the present subject matter.

In some embodiments, after the DAI status is determined, a state machine is executed to set the state of the system. One example of a state machine is illustrated in FIG. 5. The DAI status is determined by comparing the DAI signal level to two thresholds, and this will control the transition between states. Therefore, the status of the system (DAI power level) is determined before running the state machine. Also, there are two counters loaded into SM_Counter (FIG. 5) that control the transitions from State B (Dormant State) to State A (OFF State) and from State C (Active State) to State B. These two counters eliminate unnecessary jumps between states due to abrupt signal changes or the short silence periods in speech during conversation.

Figure 6:
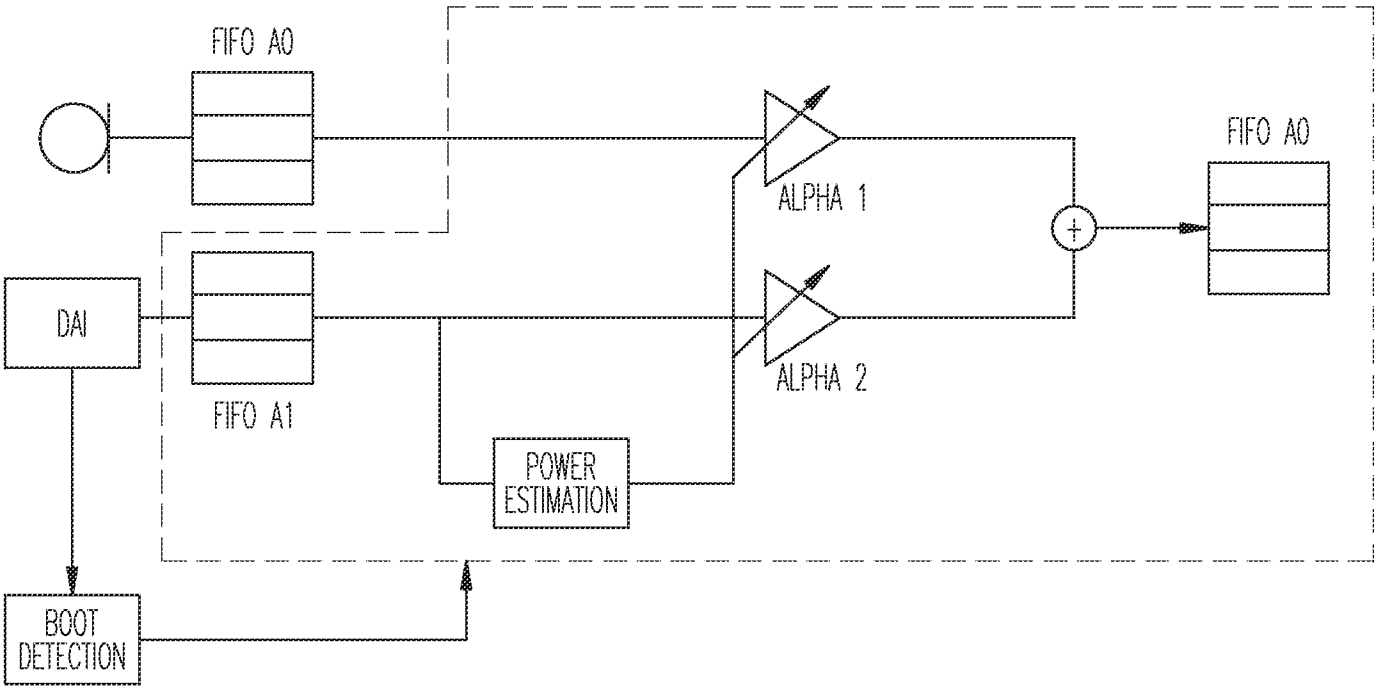
FIG. 6 is a block diagram showing the combination of direct audio input signals and a microphone input signal according to one embodiment of the present subject matter.

The DAI signal is combined to the HA (hearing aid) signal with proper weighting (one example is provided in FIG. 6), the weights summarized in Table 1 are set according to the selected DAI functionality. The various modes are described below. It is understood that the modes, signal diagram, and weights may vary without departing from the scope of the present subject matter.

TABLE 1

DAI and HA combining weights

| | DAI ONLY | | STATIC DAI + HA (0 dB) | | STATIC DAI + HA (+6 dB) | | STATIC DAI + HA (10 dB) | | DYNAMIC DAI + HA (6 dB) | | DYNAMIC DAI + HA (10 dB) | |
|---|---|---|---|---|---|---|---|---|---|---|---|---|
| | $\alpha_1$ | $\alpha_2$ | $\alpha_1$ | $\alpha_2$ | $\alpha_1$ | $\alpha_2$ | $\alpha_1$ | $\alpha_2$ | $\alpha_1$ | $\alpha_2$ | $\alpha_1$ | $\alpha_2$ |
| Active | 0 | 1 | 1 | 1 | .5 | 1 | .3162 | 1 | .5 | 1 | .3162 | 1 |
| Dormant | 1 | 1 | 1 | 1 | .5 | 1 | .3162 | 1 | 1 | 1 | 1 | 1 |
| OFF | 1 | 0 | 1 | 0 | 1 | 0 | 1 | 0 | 1 | 0 | 1 | 0 |

Note:
.5 and .3162 correspond to +6 dB and +10 dB advantage of DAI signal.

Modes

In various embodiments, a plurality of processing modes shall be available for DAI usage, including but not limited to one or more of the following modes:

DAI only mode—in this mode the signal having priority in the signal processing channel of the hearing aid is primarily the signals coming from the DAI port.

hearing aid plus DAI mode—this mode provides for mixing of the microphone signal(s) of the hearing aid and the signals from the DAI port.

hearing aid plus DAI with a +6 dB dynamic DAI advantage mode—this mode provides a 6 dB advantage to the DAI signal as compared to the microphone signal(s), but only when signals of interest are detected from the DAI port.

hearing aid plus DAI with a +10 dB DAI dynamic advantage mode—this mode provides a 10 dB advantage to the DAI signal as compared to the microphone signal(s), but only when signals of interest are detected from the DAI port.

hearing aid plus DAI with a +6 dB static DAI advantage mode—this mode provides a 6 dB advantage to the DAI signal as compared to the microphone signal(s), regardless of whether signals of interest are detected from the DAI port.

hearing aid plus DAI with a +10 dB static DAI advantage mode—this mode provides a 10 dB advantage to the DAI signal as compared to the microphone signal(s), regardless of whether signals of interest are detected from the DAI port.

The hearing aid plus DAI with a dynamic +6/+10 dB DAI advantage mode shall decrease the input level from the hearing aid microphone by 6/10 dB when the DAI is transmitting a signal detected to be a signal of interest (also called a "live signal"). When the DAI is transmitting information that is deemed not to be of interest (also called a "dormant signal"), there shall be no DAI advantage.

In the hearing aid plus DAI modes with a dynamic DAI advantage, the default time constants shall be 3 seconds for the decrease in the hearing aid microphone input level and 1 second for the increase in the hearing aid microphone input level, according to one embodiment of the present subject matter. These time constants are programmable and can be changed. In one embodiment, the time constants are based on the current time constants for noise management. In various embodiments, additional time constants are used. For example, two alternative time constants may be employed for the decrease in the hearing aid microphone input (one may be greater than 3 seconds and one may be less than 3 seconds) and two alternative time constants for the increase in the hearing aid microphone input (one may be greater than 1 second and one may be less than 1 second). These time constants can be selectable using fitting software, in various embodiments.

In various embodiments, the fitting software shall provide option to select DAI mode for any non-telephone hearing aid memory of a hearing assistance device (such as a hearing aid). If a telephone environment (for example, telephone, automatic telephone, telecoil, or auto coil environments) is selected for a given memory, then in various embodiments the DAI mode option may be withdrawn for that memory. Other modes of DAI operation, such as where the DAI is disabled, may reduce the implementation complexities of handling any telephone environment by DAI module. This mode can be selected by a professional in various embodiments.

In various embodiments pertaining to devices providing acoustic feedback cancellation, there can be some conditions where the configuration of feedback canceller may be changed according to DAI mode and status to further benefit the use of the DAI port. If the feedback canceller is set to static mode, it should be forced to adaptive mode whenever the microphone signal is attenuated by a DAI mode from its original level. This could happen when the current memory is programmed to support DAI modes where there is a 6 or 10 dB advantage for direct audio signal. Obviously, when the microphone signal is lower than what was used for static echo cancellation, the original static settings of a feedback canceller may not correctly eliminate the audio signal leakage from receiver to microphone. Therefore, the feedback canceller is temporarily set to adaptive mode to compensate for the attenuation of microphone signal. One can implement this function by having the DAI and the hearing aid combine weights from Table 1. It is understood from this table that, for DAI modes with a 6 or 10 dB DAI advantage, the feedback canceller should be forced to adaptive mode when $\alpha_1$ takes any value other than 1. For the DAI Only mode, the feedback canceller is turned off while DAI is detected to be ON. For this mode, this condition is equivalent to DAI being in active or dormant state. Other settings are possible without departing from the scope of the present subject matter.

Thus, in various embodiments, the hearing assistance device, includes a processor; and a direct audio input (DAI) port including a signal line connected to the processor; wherein the DAI port is configured to connect to another device, the processor is configured to detect signals of interest (including, but not limited to audio or speech) on the signal line and to process the signals of interest when detected as programmed.

The present subject matter can be used for a variety of hearing assistance devices including a direct audio connection, including but not limited to, assistive listening devices (ALDs), tinnitus masking devices, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a processor; and a direct audio input (DAI) port including a signal line connected to the processor, wherein the DAI port is configured to connect to an external device, and the processor is programmed to detect audio signals of interest on the signal line, including comparing a level of the audio signals of interest to a threshold, and to process the audio signals of interest when detected as programmed.

2. The device of claim 1, further comprising a microphone, and wherein the processor is programmed to mix the audio signals of interest with sounds detected by the microphone.

3. The device of claim 2, wherein the sounds detected by the microphone are attenuated by a programmable amount and the audio signals of interest are played to the wearer.

4. The device of claim 3, wherein the programmable amount is approximately 6 dB.

5. The device of claim 1, further comprising the external device, wherein the external device includes an FM device.

6. The device of claim 5, wherein, when the FM device is off or out of range, the DAI port is in an off state so as to not receive noise coming from the FM device.

7. The device of claim 5, wherein, when the FM device is on and provides an audio signal, the DAI port is in an active state to receive the audio signals.

8. The device of claim 5, wherein, when the FM device is on but no audio is present for a predetermined time, the DAI port is configured to enter a dormant state.

9. The device of claim 1, further comprising the external device, wherein the external device includes a wireless receiver.

10. The device of claim 9, wherein the wireless receiver includes a BLUETOOTH receiver.

11. The device of claim 1, further comprising the external device, wherein the external device includes a magnetic induction receiver.

12. The device of claim 1, further comprising the external device, wherein the external device includes a wired audio connection.

13. The device of claim 1, further comprising the external device, wherein the external device includes a cellular telephone.

14. A method, comprising:

detecting a signal of interest from a signal received at a direct audio input (DAI) port of a hearing assistance device, wherein detecting the signal of interest includes comparing a level of the signal of interest to a threshold; and processing the signal of interest based on programming of a processor connected to the DAI port.

15. The method of claim 14, wherein detecting the signal of interest includes comparing a level of the signal of interest to multiple thresholds.

16. The method of claim 15, wherein processing the signal of interest includes selecting from a plurality of processing modes to enter upon detecting the signal of interest.

17. The method of claim 16, wherein one of the plurality of processing modes includes processing only the signal of interest.

18. The method of claim 16, wherein one of the plurality of processing modes includes mixing a signal from a microphone of the hearing assistance device with the signal of interest detected at the DAI port.

19. The method of claim 18, wherein mixing the signal from the microphone with the signal of interest detected at the DAI port includes providing a preference to the DAI signal as compared to the microphone signal.

20. The method of claim 19, wherein providing a preference to the DAI signal includes decreasing an input level of the microphone signal by at least 6 dB.

21. A hearing assistance device, comprising:

a microphone;

a processor; and a direct audio input (DAI) port including a signal line connected to the processor, wherein the DAI port is configured to connect to an external device, and the processor is programmed to detect audio signals of interest on the signal line and to process the audio signals of interest when detected as programmed, and wherein the processor is programmed to mix the audio signals of interest with sounds detected by the microphone.

22. The device of claim 21, wherein the sounds detected by the microphone are attenuated by a programmable amount and the audio signals of interest are played to the wearer.

23. The device of claim 22, wherein the programmable amount is approximately 6 dB.

24. A hearing assistance device, comprising:

a microphone;

a processor; and a direct audio input (DAI) port including a signal line connected to the processor, wherein the DAI port is configured to connect to an external device, and the processor is programmed to detect audio signals of interest on the signal line and to process the audio signals of interest when detected as programmed, further comprising the external device, wherein the external device includes an FM device, and wherein, when the FM device is off or out of range, the DAI port is in an off state so as to not receive noise coming from the FM device.

25. A hearing assistance device, comprising:

a microphone;

a processor; and a direct audio input (DAI) port including a signal line connected to the processor, wherein the DAI port is configured to connect to an external device, and the processor is programmed to detect audio signals of interest on the signal line and to process the audio signals of interest when detected as programmed, further comprising the external device, wherein the external device includes an FM device, and wherein, when the FM device is on and provides an audio signal, the DAI port is in an active state to receive the audio signals.

26. A hearing assistance device, comprising:

a microphone;

a processor; and a direct audio input (DAI) port including a signal line connected to the processor, wherein the DAI port is configured to connect to an external device, and the processor is programmed to detect audio signals of interest on the signal line and to process the audio signals of interest when detected as programmed, further comprising the external device, wherein the external device includes an FM device, and wherein, when the FM device is on but no audio is present for a predetermined time, the DAI port is configured to enter a dormant state.

27. A method, comprising:

detecting a signal of interest from a signal received at a direct audio input (DAI) port of a hearing assistance device; and processing the signal of interest based on programming of a processor connected to the DAI port, wherein detecting the signal of interest includes comparing a level of the signal of interest to multiple thresholds.

28. The method of claim 27, wherein processing the signal of interest includes selecting from a plurality of processing modes to enter upon detecting the signal of interest.

29. The method of claim 28, wherein one of the plurality of processing modes includes processing only the signal of interest.

30. The method of claim 28, wherein one of the plurality of processing modes includes mixing a signal from a microphone of the hearing assistance device with the signal of interest detected at the DAI port.

31. The method of claim 30, wherein mixing the signal from the microphone with the signal of interest detected at the DAI port includes providing a preference to the DAI signal as compared to the microphone signal.

32. The method of claim 31, wherein providing a preference to the DAI signal includes decreasing an input level of the microphone signal by at least 6 dB.

* * * * *

UNITED STATES PATENT AND TRADEMARK OFFICE

CERTIFICATE OF CORRECTION

PATENT NO. : 8,503,708 B2
APPLICATION NO. : 12/982526
DATED : August 6, 2013
INVENTOR(S) : Galster et al.

It is certified that error appears in the above-identified patent and that said Letters Patent is hereby corrected as shown below:

On the Title Page

On page 2, column 2, under "Other Publications", line 27, delete "Mailed" and insert --mailed--, therefor On page 2, in column 2, under "Other Publications", line 55, delete "U.S." and insert --"U.S.--, therefor On page 2, in column 2, under "Other Publications", line 55, delete "11/689,362 ," and insert --11/689,362,--, therefor On page 2, in column 2, under "Other Publications", line 56, delete "2012," and insert --2012",--, therefor On page 2, in column 2, under "Other Publications", line 57, delete "U.S." and insert --"U.S.--, therefor On page 2, in column 2, under "Other Publications", line 58, delete "2012," and insert --2012",--, therefor On page 2, in column 2, under "Other Publications", line 59, delete "U.S." and insert --"U.S.--, therefor On page 2, in column 2, under "Other Publications", line 60, delete "maield" and insert --mailed--, therefor On page 2, in column 2, under "Other Publications", line 60, delete "2011," and insert --2011",--, therefor Signed and Sealed this
Thirteenth Day of January, 2015

Michelle K. Lee

Michelle K. Lee
*Deputy Director of the United States Patent and Trademark Office*

On page 2, in column 2, under “Other Publications”, line 61, delete “U.S.” and insert --“U.S.--, therefor On page 2, in column 2, under “Other Publications”, line 62, delete “2011,” and insert --2011”,--, therefor